US008457532B2

(12) United States Patent
Frydman et al.

(10) Patent No.: US 8,457,532 B2
(45) Date of Patent: Jun. 4, 2013

(54) ELECTROPHOTOGRAPHIC PRINTING

(75) Inventors: Iian Frydman, Nes Ziona (IL); Dror Kella, Nes Ziona (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 369 days.

(21) Appl. No.: 12/808,791

(22) PCT Filed: Dec. 18, 2007

(86) PCT No.: PCT/US2007/025903

§ 371 (c)(1),
(2), (4) Date: Jun. 17, 2010

(87) PCT Pub. No.: WO2009/078840

PCT Pub. Date: Jun. 25, 2009

(65) Prior Publication Data

US 2011/0217082 A1 Sep. 8, 2011

(51) Int. Cl.
*G03G 15/11* (2006.01)

(52) U.S. Cl.
USPC ..... 399/240; 399/241

(58) Field of Classification Search
USPC ..... 399/66, 240, 241
See application file for complete search history.

(56) References Cited

U.S. PATENT DOCUMENTS

| | | | | |
|---|---|---|---|---|
| 5,777,651 | A | 7/1998 | Facci et al. | |
| 6,472,115 | B2 | 10/2002 | Uezono et al. | |
| 2002/0106220 | A1 * | 8/2002 | Nakashima et al. | 399/237 |

FOREIGN PATENT DOCUMENTS

| | | |
|---|---|---|
| JP | 08-258269 | 10/1996 |
| JP | 16-216782 | 8/2004 |

* cited by examiner

*Primary Examiner* — Walter L Lindsay, Jr.
*Assistant Examiner* — Barnabas Fekete

(57) ABSTRACT

Electrophotographic printing apparatus and method of printing using electrophotographic printing apparatus, the apparatus comprising an image-forming member having a surface on which a latent electrostatic image can be formed and developed for transfer of the developed image to a substrate via an intermediate transfer member. The apparatus comprises a voltage supply for generating electric potential between the surface of the intermediate transfer member and the image-forming member such that the developed image formed on the surface of the image-forming member is transferred to the intermediate transfer member. A controller of the apparatus controls the voltage supply to adjust the electrical potential to affect the transfer of ink to the intermediate transfer member from the image-forming member. In this way, the apparatus can adjust for changes in the electrical properties of the intermediate transfer member.

18 Claims, 2 Drawing Sheets

ELECTROPHOTOGRAPHIC PRINTING

FIELD OF INVENTION

This invention relates to electrophotographic printing.

BACKGROUND

Electrophotographic printing apparatus may comprise an image forming drum upon which an image is developed and an intermediate transfer member for transferring the developed image to a substrate. The intermediate transfer member is a drum or belt comprising a blanket typically comprising a conducting layer underlying a release coating elastomer layer. To transfer the image, the intermediate transfer member is charged to a predetermined voltage to generate an electrical potential between the intermediate transfer member and the image-forming drum causing the charged ink particles or charged toner to be attracted to the intermediate transfer member.

The blankets of the intermediate transfer member deteriorate over time making it advantageous, on occasion, to replace the blanket to maintain the performance of the apparatus. However, different blankets can have different thickness of a top layer above the conducting layer, including for example the release coating. For example, the thickness of the top layer for different blankets has been known to vary by up to 6 μm. These variations in thickness can change the electrical resistance of the blanket thereby changing the electrical potential generated between the image forming member and the intermediate transfer member when the predetermined voltage is applied. Variations in electrical potential affect the proportion of ink particles transferred to the intermediate transfer member which in turn affects print quality.

Current apparatus reduce the deterioration in print quality through a process called color adjustment. In this process, the amount of ink particles used to develop the image on the image forming drum is increased such that the amount of ink particles transferred to the intermediate transfer member remains substantially the same even though the proportion of ink particles transferred to the intermediate transfer member is reduced. The remaining ink particles not transferred to the intermediate transfer member are cleaned from the image-forming drum and thrown away after being separated via filters from the carrier liquid.

This process of color adjustment results in significant amounts of ink particles being thrown away and restricts the lifetime of the filters.

SUMMARY OF INVENTION

Aspects of the invention comprise a system and method as defined in the claims appended hereto.

According to another aspect of the invention, there is provided a controller for electrophotographic printing apparatus comprising:— an image-forming member having a surface on which a latent electrostatic image can be formed and developed for transfer of the developed image to a substrate, a developer for depositing onto the surface of the image-forming member a layer of ink comprising charged ink particles to develop the latent image, an intermediate transfer member for transferring the developed image to the substrate; and a voltage supply for generating an electric potential between the surface of the intermediate transfer member and the image-forming member such that the developed image formed on the surface of the image-forming member is transferred to the intermediate transfer member;

the controller arranged for controlling the voltage supply to adjust the electrical potential to affect the transfer of ink to the intermediate transfer member from the image-forming member.

According to another aspect of the invention, there is provided a data carrier having stored thereon instructions for execution by a processor of a controller of an electrophotographic printing apparatus, the electrophotographic printing apparatus comprising:— an image-forming member having a surface on which a latent electrostatic image can be formed and developed for transfer of the developed image to a substrate, a developer for depositing onto the surface of the image-forming member a layer of ink comprising charged ink particles to develop the latent image;

an intermediate transfer member for transferring the developed image to the substrate; and a voltage supply for generating electric potential between the surface of the intermediate transfer member and the image-forming member such that the developed image formed on the surface of the image-forming member is transferred to the intermediate transfer member; and a controller comprising a processor for controlling the voltage supply;

wherein, when the instructions are executed by the processor of the controller, the controller is caused to adjust the electrical potential to affect the transfer of ink to the intermediate transfer member from the image-forming member.

According to another aspect of the invention, there is provided a controller for electrophotographic printing apparatus comprising:— an image-forming member having a surface on which a latent electrostatic image can be formed and developed for transfer of the developed image to a substrate, a developer for depositing onto the surface of the image-forming member a layer of ink comprising charged ink particles to develop the latent image, an intermediate transfer member for transferring the developed image to the substrate;

a voltage supply for generating an electric potential between the surface of the intermediate transfer member and the image-forming member such that the developed image formed on the surface of the image-forming member is transferred to the intermediate transfer member, and an optical device for measuring the optical density of an image printed on a substrate;

the controller arranged to:— control the image-forming member, developer, intermediate transfer member and voltage supply to print on one or more substrates a predetermined set of images, wherein each image of the set of images is printed with a different electric potential provided between the intermediate transfer member and the image-forming member, receive measurements of the optical density of each of the set of images from the optical device, and set the voltage supply to generate, for further printing, an electric potential between the image-forming member and the intermediate transfer member that produced an image of the set of images with a required optical density.

According to another aspect of the invention, there is provided a data carrier having stored thereon instructions for execution by a processor of a controller of an electrophotographic printing apparatus, the electrophotographic printing apparatus comprising:— an image-forming member having a surface on which a latent electrostatic image can be formed and developed for transfer of the developed image to a substrate, a developer for depositing onto the surface of the image-forming member a layer of ink comprising charged ink particles to develop the latent image;

an intermediate transfer member for transferring the developed image to the substrate;

a voltage supply for generating an electric potential between the surface of the intermediate transfer member and the image-forming member such that the developed image formed on the surface of the image-forming member is transferred to the intermediate transfer member, and an optical device for measuring the optical density of an image printed on a substrate; and a controller comprising a processor for controlling the voltage supply;

wherein, when the instructions are executed by the processor of the controller, the controller is caused to:— control the image-forming member, developer, intermediate transfer member and voltage supply to print on one or more substrates a predetermined set of images, wherein each image of the set of images is printed with a different electric potential provided between the intermediate transfer member and the image-forming member, receive measurements of the optical density of each of the set of images from the optical device, and set the voltage supply to generate, for further printing, an electric potential between the image-forming member and the intermediate transfer member that produced an image of the set of images with the a required optical density.

BRIEF DESCRIPTION OF THE DRAWINGS

Embodiments of the invention will now be described, by example only, with reference to the accompanying drawing, in which:—

Referring to FIG. 1, electrophotographic printing apparatus comprises an image-forming device 1 for printing an image onto a substrate 42, such as paper. The image-forming device 1 is connectable to one or more ink tanks (not shown). The ink used in the apparatus comprises charged ink particles carried in a carrier medium. Typically about 2% of the ink by weight is ink particles.

Figure 1:
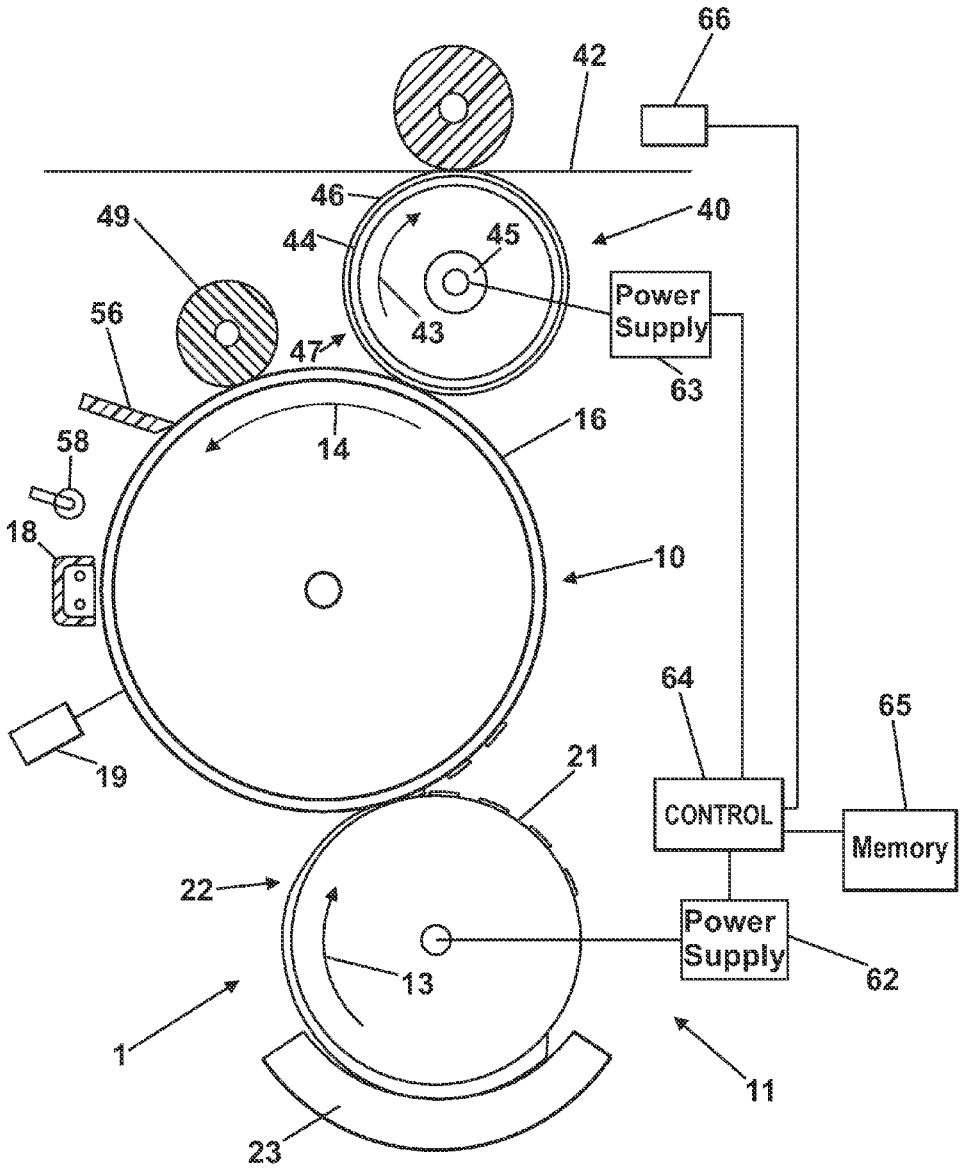
FIG. 1 is a schematic view of an embodiment of electrophotographic printing apparatus in accordance with the invention.

The image-forming device 1 comprises an image-forming member 10 in the form of a drum and a developer 11 for depositing onto a surface 16 of the drum 10 a layer of ink. In this embodiment, the developer 11 is an HP-Indigo-type BID (Binary Image Developer), however it will be understood that in other embodiments of the invention other types of developer could be used.

The surface 16 is, in this example, a photoreceptor surface made of selenium, a selenium compound, an organic photoconductor or any other suitable photoconductor known in the art on which a latent electrostatic image can be formed.

During operation, drum 10 rotates, in this embodiment in an anticlockwise direction indicated by arrow 14, and a charger 18 charges photoreceptor surface 16. Charger 18 may be any type of charger known in the art, such as a corotron, a scorotron or a roller.

Continued rotation of drum 10 brings the charged photoreceptor surface 16 into alignment with an exposure device, for example a light source 19, such that the charged photoreceptor surface 16 is exposed to light emitted by the exposure device. The light source 19 may be a laser scanner (in the case of a printer) or the projection of an original (in the case of a photocopier). Light source 19 forms a desired latent image on the charged photoreceptor surface 16 by selectively discharging a portion of the photoreceptor surface 16, image portions being at a first voltage and background portions adjacent the image portions at a second voltage. The discharged portions may have a voltage of less than about 100 Volts.

In this embodiment, developer 11 comprises a developer roller 22 and continued rotation of drum 10 brings the selectively charged photoreceptor surface 16 into engagement with an ink-bearing surface 21 of a developer roller 22. It will be understood that even though only one developer 11 is shown in the drawing, the apparatus may comprise more than one developer. For example, in one embodiment, the apparatus comprises four developers, one for each ink color, black, cyan, magenta and yellow ink.

Developer roller 22 rotates in an opposite direction to that of drum 10, in this embodiment, clockwise as shown by arrow 13, and at a set angular velocity and may be urged against drum 10.

An applicator assembly 23 of developer 11 coats surface 21 with a thin layer of ink. The applicator assembly 23 is supplied with ink from an ink tank (not shown) and one or more electrodes of the applicator assembly 23 charges the ink as it is deposited onto the ink-bearing surface 21 of developer roller 22.

The ink bearing surface 21 is charged to an electric potential by power supply 62 to form an electric potential between surface 22 of developer roller 21 and surface 16 of drum 10 such that, as the developer roller 22 rotates and the ink on surface 21 aligns with photoreceptor surface 16 of drum 10, the difference in potential between the surface 21 and surface 16 causes selective transfer of the layer of ink particles to surface 16, thereby developing the latent image. Depending on the choice of ink charge polarity and the use of a "write-white" or "write-black" system, as known in the art, the layer of ink particles will be selectively attracted to either the charged or discharged areas of surface 16.

The developer 11 may comprise a squeegee roller (not shown) that applies pressure to ink on the ink-bearing surface 21 before it becomes aligned with surface 16 of drum 10. The squeegee roller causes the ink to be spread evenly across surface 21.

The developer 11 may comprise a cleaning assembly (not shown) that removes unused ink (ink that has not been transferred to surface 16 of drum 10) from the ink-bearing surface 21.

The developed image formed on the drum 10 is transferred to a desired substrate 42 via an intermediate transfer member 40. In this embodiment, the intermediate transfer member is a drum 40 or belt comprising a blanket 47 typically comprising a conducting layer 44 underlying a top (release coating) elastomer layer 46, which may be a slightly conductive resilient polymeric layer. The intermediate transfer member 40 is in operative engagement with photoreceptor surface 16 of drum 10 bearing the developed image and rotates in a direction opposite to that of photoreceptor surface 16, as shown by arrow 43, providing substantially zero relative motion between their respective surfaces at the point of image transfer.

Transfer of the image to intermediate transfer member 40 is aided by providing electrification of intermediate transfer member 40 by adjustable power supply 63 to generate an electric potential between intermediate transfer member 40 and the photoreceptor surface 16 of drum 10. The power supply 63 is controlled by controller 64 to charge intermediate transfer member 40 to a voltage based on a voltage value stored in memory 65. This voltage value is determined by a calibration process, described below, such that the electric potential generated between surface 16 of drum 10 and the surface of the intermediate transfer member 40 achieves an acceptable level of transfer of ink therebetween.

Following the transfer of the developed image to intermediate transfer member 40, the rotating photoreceptor surface 16 encounters and engages a cleaning station 49 which cleans most or substantially all charged particles remaining on the surface 16.

In this embodiment, a scraper 56 completes the removal of any residual ink, ink particles or carrier liquid, which may not have been removed by cleaning station 49.

The apparatus 1 also comprises an optical device, such as a densitometer 66, for measuring the optical density of an image printed on the substrate 42. Signals indicative of the measured values of optical density are sent from the densitometer 66 to the controller 64.

To compensate for variations in the electrical resistance of the blanket 47, for example due to degradation of the blanket over time or when the blanket 47 is replaced, the controller 64 is programmed to carry out a calibration process. This calibration may be carried out regularly, for example, periodically, or only when the blanket 47 is replaced. In response to the calibration, the voltage value stored in memory 65 to which the intermediate transfer member 40 is charged is adjusted such that the power supply 63 is caused to charge the intermediate transfer member 40 to this adjusted voltage. In this way, the electric potential generated between surface 16 of drum 10 and the intermediate transfer member 40 is adjusted to compensate for changes in the properties of the blanket 47 affecting the transfer of ink such that an acceptable level of ink transfer may be achieved/maintained without having to increase the amount of ink on drum 10.

Figure 2:
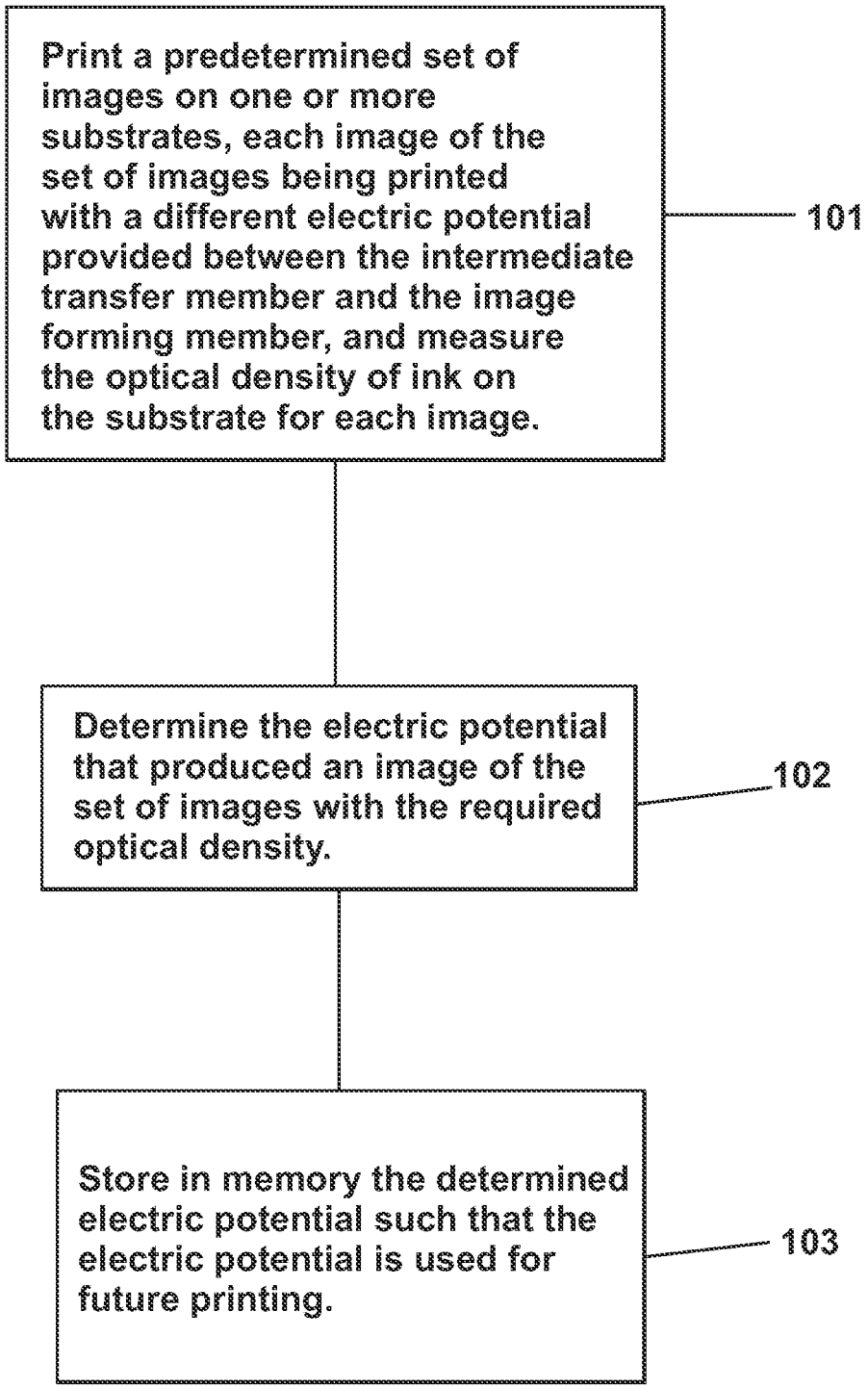
FIG. 2 is a flowchart detailing a method in accordance with an embodiment of the invention.

A method of calibrating the intermediate transfer member 40 will now be described with reference to FIG. 2.

On switching to a calibration mode, the controller, in step 101, controls the apparatus 1 to cause the apparatus to print a predetermined set of images on to one or more substrates. Each image is printed using a different voltage applied to the intermediate transfer member 40 by the power supply 63.

The different voltages may comprise predetermined voltage steps spread across a range of voltages. In this embodiment, the voltage of the intermediate transfer member is changed from 400V to 600V in steps of 20V, therefore producing 21 images. For each image, the amount of ink transferred to surface 16 of drum 10 by developer 11 when developing the image is maintained substantially constant.

It will be understood that other voltage ranges could be used for the calibration and other voltage steps could be used, with smaller steps increasing the sensitivity of the calibration.

The densitometer 66 measures the optical density of each image and generates an appropriate optical density signal indicative of the measurement that is sent to the controller 64. The controller 64 stores the measured value(s) for each image in memory 65 associating the measured optical density value with the voltage that was used to print the image that produced that measurement. The controller 64, in step 102, compares the measured values and determines from the measured values of optical density, a voltage that produced an image with the required optical density.

In the last step, 103, the controller 64 stores this voltage value in memory 65 such that this voltage is used by the apparatus 1 for future printing.

The controller 64 may select the appropriate voltage to store in memory 65 in a number of ways and how it selects this voltage will depend on the set of images that are printed.

In one embodiment, the set of images comprises areas printed with the same percentage of dot coverage, for example 100% dot coverage patches, each area printed with a different voltage applied to the intermediate transfer member 40. The appropriate voltage to be used for future printing is then determined by identifying the lowest voltage that produces the highest optical density for a 100% dot coverage patch. It is anticipated that a range of voltages will achieve the highest optical density, i.e. there will be a working window of electric potentials, and the controller 64 is arranged to select the lowest of these voltages within the working window.

In another embodiment, each image of the set of images may comprise at least two areas printed with a different percentage of dot coverage, for example 50% and 100% dot coverage patches. The appropriate voltage to be used for future printing is then determined by identifying the lowest voltage that produces a required ratio of optical density between the two areas.

Alternatively, the appropriate voltage to be used for future printing may be determined by identifying the lowest voltage that produces the highest optical density for a 100% dot coverage patch and that produces a required ratio of optical density between the two areas.

This embodiment of the invention may obviate the need to increase the amount of ink applied to the drum 10 when the blanket 46 is changed as the apparatus adjusts the voltage applied to the intermediate transfer member to affect the transfer of ink between the drum 10 and the intermediate transfer member 40 such that the required print quality is maintained. As it may not be necessary to increase the amount of ink used to develop to image on drum 10 when a blanket is changed/deteriorates, it may be possible to save on the amount of ink used by the apparatus and reduce the rate of deterioration of filters of the apparatus.

It will be understood that the invention is not limited to the above-described embodiment, but includes modifications and alterations that fall within the scope of the invention as defined in the claims.

For example, in one embodiment, the calibration comprises measuring electrical properties, for example electrical resistance, of the interface between the blanket 47 and surface 16 of drum 10 wherein the voltage to which the intermediate transfer member 40 is charged is altered based on the measured electrical property. For example, a look-up table may be stored in memory 65 and the voltage to which the intermediate transfer member 40 is to be charged during printing may be based on the voltage value in the look-up table associated with the measured value of electrical resistance. The values of the look-up table are set so as to increase or decrease the voltage to compensate for increases or decreases in electrical resistance, thereby affecting the transfer of ink to the intermediate transfer member 40 to ensure the transfer of ink stays within acceptable levels.

In another embodiment, the apparatus 1 comprises means for measuring, either mechanically or electrically, properties such as thickness of the top layer 46, of the blanket 47 wherein the voltage to which the intermediate transfer member 40 is charged is altered based on the thickness of the blanket. As with the above described embodiment, a look-up table may be stored in memory 65 and the voltage to which the intermediate transfer member 40 is to be charged during printing may be based on the voltage associated with the corresponding blanket thickness in the look-up table. The values of the look-up table are set so as to increase or decrease the voltage to compensate for increases or decreases in blanket thickness, thereby affecting the transfer of ink to the intermediate transfer member 40 to ensure the transfer of ink stays within acceptable levels. This embodiment may further comprise user inputs for the user to input the type of material from which the blanket is made or the manufacturer such that controller 64 can compensate for expected variations in ink transfer for different material types or between the blankets of different manufacturers.

In one embodiment, the thickness of the top layer 46 of the blanket 47 is measured by connecting the top layer 46 in circuit with a resistive element and measuring the voltage drop across the resistive element. This measurement of electrical resistance then can be extrapolated to determine the thickness of the top layer 46 and/or to determine the voltage to be used for future printing. Again this could be done through use of a look-up table.

In yet another embodiment, the measurement of the blanket thickness could be carried out offline, for example by the manufacturer of the blanket, or nearline, for example by a user of the printing apparatus, and the measured value of the thickness of the blanket input into controller 64.

The voltage to be applied to the intermediate transfer member 40 may be determined by applying an appropriate function, such as a linear function, for example, $$V_{ITM} = V_{Ref} + V_T \frac{(T - T_{Ref})}{T_{Ref}}$$

wherein $V_{ITM}$ is the voltage applied to the intermediate transfer member during future printing, $V_{Ref}$ is the voltage applied to the intermediate transfer member for a top layer thickness $T_{Ref}$, $V_T$ is the voltage increment per micron increase in the thickness of the top layer and T is the measured thickness of the top layer 47 in microns. In one embodiment, $V_{Ref}$ is 400V, $V_T$ is 200V/μm and $T_{Ref}$ is 6 μm.

In yet another embodiment, the amount of ink removed from the image-forming drum 10 by cleaning station 49 is measured with a turbidity sensor which can be mounted in a conduit that transports the ink from the cleaning station 49 to a reservoir. Controller 64 is arranged to calculate the percentage of ink transferred to the intermediate transfer member 46 from the measurement made by the turbidity sensor and knowledge of the amount of ink transferred to the image forming drum 10 from developer 11. In response to the percentage of ink transferred dropping below a predetermined threshold, the voltage applied to the intermediate transfer member 46 is adjusted to affect the transfer of ink to the intermediate transfer member to maintain the transfer of ink at an acceptable level.

Features recited in dependent apparatus claims are not intended to be limited to use in apparatus claims only but equivalent claims in the other categories (method, apparatus, controller, data carrier, etc.) reciting these features are envisaged even if they are not expressly claimed.

The invention claimed is:

1. Electrophotographic printing apparatus comprising:

an image-forming member having a surface on which a latent electrostatic image can be formed and developed for transfer of the developed image to a substrate, a developer for depositing onto the surface of the image-forming member a layer of ink comprising charged ink particles to develop the latent image;

an intermediate transfer member for transferring the developed image to the substrate;

a voltage supply for generating electric potential between the surface of the intermediate transfer member and the image-forming member such that the developed image formed on the surface of the image-forming member is transferred to the intermediate transfer member; and a controller for controlling the voltage supply to adjust the electrical potential to affect the transfer of ink to the intermediate transfer member from the image-forming member, wherein the controller is arranged to receive a signal indicative of a proportion of ink of the developed image transferred by the intermediate transfer member and cause the voltage supply to adjust the electrical potential in response to the signal.

2. Electrophotographic printing apparatus comprising:

an image-forming member having a surface on which a latent electrostatic image can be formed and developed for transfer of the developed image to a substrate, a developer for depositing onto the surface of the image-forming member a layer of ink comprising charged ink particles to develop the latent image;

an intermediate transfer member for transferring the developed image to the substrate;

a voltage supply for generating electric potential between the surface of the intermediate transfer member and the image-forming member such that the developed image formed on the surface of the image-forming member is transferred to the intermediate transfer member: and a controller for controlling the voltage supply to adjust the electrical potential to affect the transfer of ink to the intermediate transfer member from the image-forming member, wherein the controller is arranged to receive an optical density signal indicative of the optical density of an image transferred to the substrate by the intermediate transfer member and cause the voltage supply to adjust the electrical potential in response to the optical density signal.

3. Electrophotographic printing apparatus according to claim 2, wherein the controller is arranged to control the image-forming member, developer, intermediate transfer member and voltage supply to print on one or more substrates a predetermined set of images, wherein each image of the set of images is caused to be printed with a different electrical potential provided between the intermediate transfer member and the image-forming member, receive optical density signals indicative of the optical density of each of the set of images from an optical device, and set the voltage supply to generate, for further printing, an electrical potential between the image-forming member and the intermediate transfer member in response to the optical density signals.

4. Electrophotographic printing apparatus according to claim 3, wherein the controller is arranged to set the voltage supply to generate, for further printing, an electrical potential between the image-forming member and the intermediate transfer member that produced an image of the set of images with the highest optical density.

5. Electrophotographic printing apparatus according to claim 2 or claim 3, wherein each image of the set of images comprises a plurality of dot coverage patches, each patch having a different percentage of dot coverage, wherein the controller is arranged to set the voltage supply to generate, for further printing, an electrical potential between the image-forming member and the intermediate transfer member that produced an image with the required ratio of optical density between the different dot coverage patches.

6. Electrophotographic printing apparatus according to claim 5, wherein the plurality of dot coverage patches comprises a 100% dot coverage patch and a 50% dot coverage patch.

7. Electrophotographic printing apparatus according to claim 3, wherein the different voltages comprise predetermined voltage steps spread across a range of voltage.

8. Electrophotographic printing apparatus according to claim 7, wherein the range of voltage is 400V to 600V.

9. Electrophotographic printing apparatus according to claim 7 or claim 8, wherein each voltage step is 20V.

10. Electrophotographic printing apparatus according to claim 1, wherein the controller is arranged to cause the voltage supply to adjust the electrical potential in response to measurements indicative of an electrical resistance at an interface between the intermediate transfer member and the image-forming member.

11. Electrophotographic printing apparatus according to claim 1, wherein the controller is arranged to cause the voltage supply to adjust the electrical potential in response to measurements indicative of a thickness of a blanket of the intermediate transfer member.

12. Electrophotographic printing apparatus according to claim 11, wherein the controller is arranged to cause the voltage supply to adjust the electrical potential by supplying a voltage $V_{ITM}$ to the intermediate transfer member according to the following relationship, $$V_{ITM} = V_{Ref} + V_T \frac{(T - T_{Ref})}{T_{Ref}}$$

wherein $V_{ITM}$ is the voltage applied to the intermediate transfer member, $V_{Ref}$ is the voltage applied to the intermediate transfer member for a blanket thickness TRef, VT is the voltage increment per unit increase in the thickness of the blanket and T is the measured thickness of the blanket.

13. Electrophotographic printing apparatus according to claim 1, wherein the controller is arranged to receive signals indicative of the amount of ink cleaned from the image-forming member after transfer of ink to the intermediate transfer member and calculate the proportion of ink transferred to the intermediate transfer member from the amount of ink cleaned from the image-forming member and data on the amount of ink transferred to the image-forming member by the developer.

14. Electrophotographic printing apparatus according to claim 1, wherein the controller is arranged to cause the voltage supply to adjust the electrical potential to maintain the electrical current between the image forming member and the intermediate transfer member substantially constant.

15. A method of controlling electrophotographic printing apparatus comprising:

an image-forming member having a surface on which a latent electrostatic image can be formed and developed for transfer of the developed image to a substrate, a developer for depositing onto the surface of the image-forming member a layer of ink comprising charged ink particles to develop the latent image;

an intermediate transfer member for transferring the developed image to a substrate; and an adjustable voltage supply for generating electric potential between the surface of the intermediate transfer member and the surface of the image-forming member such that the developed image formed on the surface of the image-forming member is transferred to the surface of the intermediate transfer member;

the method comprising:

receiving a signal indicative of a proportion of ink of the developed image transferred by the intermediate transfer member; and controlling the voltage supply to adjust the electrical potential to affect the transfer of ink to the intermediate transfer member from the image-forming member in response to the signal.

16. A method of calibrating an electrophotographic printing apparatus comprising:

an image-forming member having a surface on which a latent electrostatic image can be formed and developed for transfer of the developed image to a substrate;

a developer for depositing onto the surface of the image-forming member a layer of ink comprising charged ink particles to develop the latent image; an intermediate transfer member for transferring the developed image to the substrate; and an adjustable voltage supply for generating electric potential between the surface of the intermediate transfer member and the image forming member such that the developed image formed on the surface of the image-forming member is transferred to the intermediate transfer member, the method comprising:

using the electrophotographic printing apparatus to print on one or more substrates a set of images, wherein each image of the set of images is printed with a different electrical potential provided between the intermediate transfer member and the image-forming member, measuring the optical density of each of the set of images, and setting the electrophotographic printing apparatus to use, for future printing, the electrical potential between that image-forming member and the intermediate transfer member that produced an image of the set of images with a required optical density.

17. The method of claim 15, wherein the controlling is further in response to measurements indicative of an electrical resistance at an interface between the intermediate transfer member and the image-forming member.

18. The method of claim 15, wherein the controlling is further in response to an optical density signal indicative of the optical density of an image transferred to the substrate by the intermediate transfer member.

* * * * *

UNITED STATES PATENT AND TRADEMARK OFFICE

CERTIFICATE OF CORRECTION

PATENT NO. : 8,457,532 B2
APPLICATION NO. : 12/808791
DATED : June 4, 2013
INVENTOR(S) : Iian Frydman et al.

It is certified that error appears in the above-identified patent and that said Letters Patent is hereby corrected as shown below:

In the Claims:

In column 8, line 38, in Claim 2, delete "member:" and insert -- member; --, therefor.

In column 9, line 46, in Claim 12, delete "TRef, VT" and insert -- $T_{Ref}$, $V_T$ --, therefor.

Signed and Sealed this
Twentieth Day of August, 2013

Teresa Stanek Rea
*Acting Director of the United States Patent and Trademark Office*